US005205272A

United States Patent [19]

Boyer

[11] Patent Number: 5,205,272

[45] Date of Patent: Apr. 27, 1993

[54] BOW STABILIZER AND STAND COMBINATION

[76] Inventor: Bob Boyer, P.O. Box 3707, Paso Robles, Calif. 93447

[21] Appl. No.: 715,985

[22] Filed: Jun. 17, 1991

[51] Int. Cl.[5] ..... F41B 5/00

[52] U.S. Cl. ..... 124/89; 124/88; 248/688

[58] Field of Search ..... 124/23.1, 86, 88, 89; 248/682, 688

[56] References Cited

U.S. PATENT DOCUMENTS

| | | | |
|---|---|---|---|
| 3,256,872 | 6/1966 | Koser | 124/23.1 |
| 4,054,121 | 10/1977 | Hoyt | 124/89 |
| 4,360,179 | 11/1982 | Roberts | 124/23.1 X |
| 4,615,327 | 10/1986 | Saunders | 124/89 |
| 4,993,398 | 2/1991 | Wallace | 124/23.1 |
| 5,106,044 | 4/1992 | Regard et al. | 124/23.1 X |

FOREIGN PATENT DOCUMENTS

| | | | |
|---|---|---|---|
| 65385 | 2/1947 | Denmark | 248/688 |

*Primary Examiner*—Randolph A. Reese
*Assistant Examiner*—John A. Ricci
*Attorney, Agent, or Firm*—Louis J. Bachand

[57] ABSTRACT

A combination archery bow stabilizer and stand comprising a inverted Y of rigid material of sufficient weight to act as a bow stabilizer, having a center leg 18 and two divergent legs 22, 24 the center leg being terminally connectible at the stabilizer port 16, of the bow 10, the divergent legs being outwardly extended and spread sufficiently to support all but one end of said bow 10, off the ground.

10 Claims, 2 Drawing Sheets

BOW STABILIZER AND STAND COMBINATION

FIELD OF THE INVENTION

This invention relates to archery devices, and more particularly to weight adjustable stabilizers for archery bows which are bifurcated at their outer terminus to serve as well as a stand for the support of an archery bow between uses. The invention provides a stand and stabilizer combination in which the attachment of a single device to the bow, at the stabilizer fitting, provides suitable, stabilizing increments of weight to the bow, and by virtue of the invention arrangement of the weights, a stand for the bow when not in use.

BACKGROUND OF THE INVENTION

Archery bows comprise basically a bow and a bowstring strung thereto more or less elaborately depending on the sophistication of the archery bow. In some bows, the tendency of the bow to pull horizontally left or right, or to pull vertically, is offset by the use of a stabilizer, essentially a weight placed midway along the outer curve of the bow. Typically, bows are provided with a threaded fitting at the appropriate place along the bow.

SUMMARY OF THE INVENTION

It is an object of the present invention to provide a new adjustable weight stabilizer for an archery bow, one which can be secured into the available stabilizer fitting. It is another object of the invention to provide such a stabilizer in an inverted Y configuration such that the bow can be stood on the ground and held upright by use of the stabilizer as a stand. It is a further object to provide means for readily changing the weight of the stabilizer in desired increments.

These and other objects of the invention to become apparent hereinafter are realized in a combination stabilizer and stand comprising a inverted Y of rigid material of sufficient weight to act as a bow stabilizer, the Y having a center leg and two divergent legs, the center leg being terminally connectible at the stabilizer port of the bow, the divergent legs being outwardly extended and spread sufficiently to support all but one end of the bow off the ground.

In this and like embodiments: the rigid material is plastic, wood, or metal; the center leg has male threads at the end thereof; the center and two divergent legs lie in a common plane; the Y extends normal to the bow; there are further included weights mountable to the Y at the divergent legs; the weights are mountable to the legs in predetermined increments of weight, the divergent legs define means to interconnect with the weights for mounting increments of weight to the Y for bow stabilization; the extension of the divergent legs comprises in major proportion the weights; the weights are metal discs, and means fastening the discs to each of the divergent leg in increments of weight are provided.

In a particularly preferred embodiment there is provided a combination bow stabilizer and stand comprising an inverted Y of rigid material, the Y having a center leg defining a male-threaded terminus adapted to thread connect the Y to a threaded stabilizer port on the bow, the Y having a pair of divergent legs defining terminal connection means, disc-shaped weight elements mountable to the divergent legs for adding length extension to the legs and stabilizing weight to the bow, and fastening means cooperating with the terminal connection means to support the weight elements on the legs, the legs being sufficiently extended and spread to support all but one end of the bow off the ground.

THE DRAWING

The invention will be further described as to an illustrative embodiment in conjunction with the attached drawings in which.

PREFERRED MODES

Figure 1:
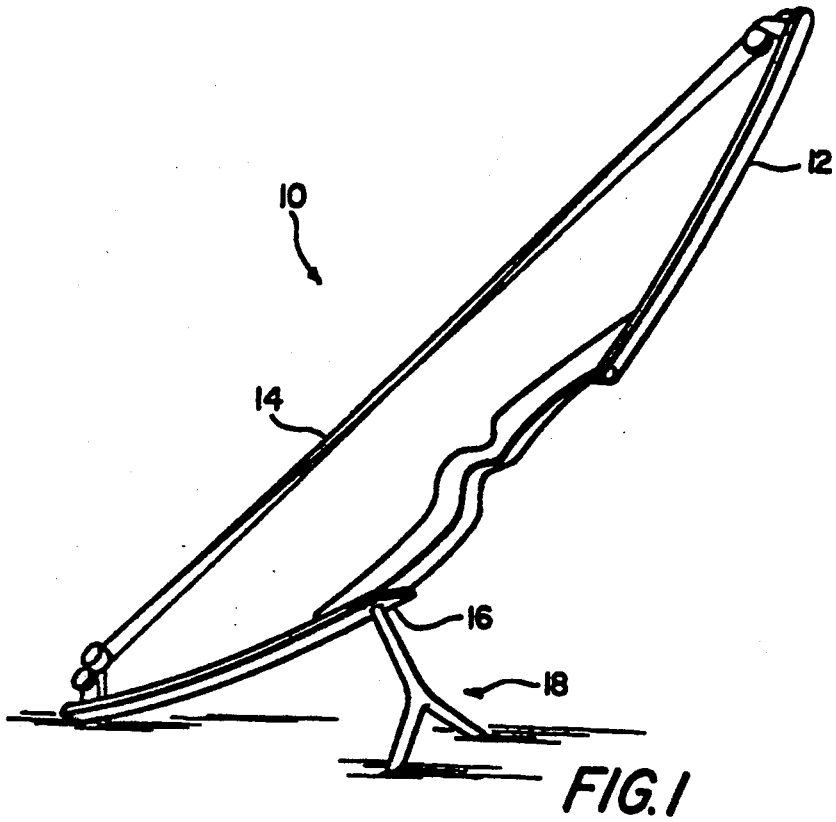
FIG. 1 is a elevational view of the apparatus in stand or stabilizer use position on an archery bow.

The invention is useful with common archery bows of both simple and compound configurations. As shown in FIG. 1, the bow 10 comprises the bow proper 12, and a bowstring 14 tautly strung between the ends of the bow. The bow is typically provided with a stabilizer port 16, usually female threaded, for attachment of weights to aid in guiding the bow accurately, the port being at the front of the bow and somewhat below the median point on the bow.

The invention device is shown at 18 in FIG. 1, in stand position, but the position of the invention device remains the same whether being used as a stand or as a stabilizer.

Figure 2:
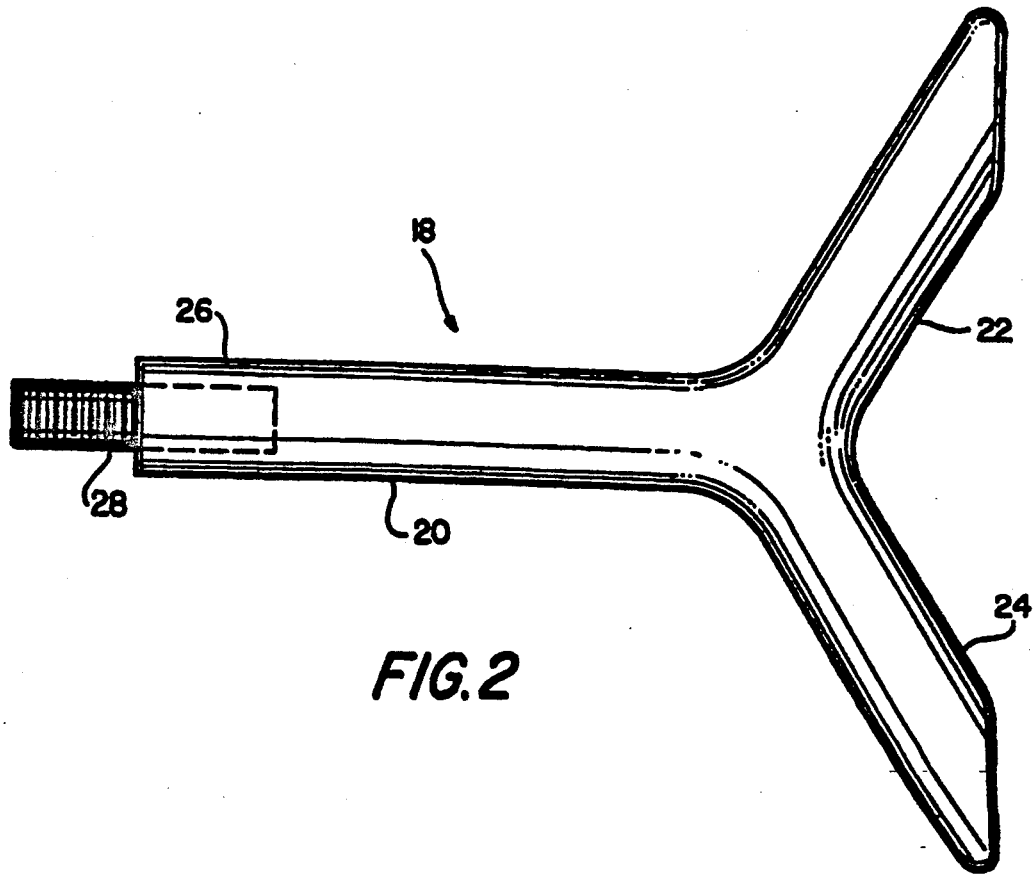
FIG. 2 is a plan view of a first embodiment of the combination stabilizer and stand.

The device 18 is shown in one form in FIG. 2 and there comprises a Y which is inverted in mounted position and comprises a center leg 20 and a pair of divergent legs 22, 24 configured basically in a Y shape. The specific overall size, the relative length of the center leg 20 to the divergent legs 22, 24 is not narrowly critical provided the Y is sufficiently extended outward to support the bow 10 approximately as shown in FIG. 1, and the divergent legs are sufficiently spread to stably support the bow in standing mode. The material of construction of the device 18 in this embodiment is suitably rigid enough to support the bow 10 and of a weight to provide the degree of stabilization required, if any. The second embodiment is better for addition of significant weight as a stabilizer. Typical dimensions for the FIG. 2 embodiment include overall length 5 to 9 inches, length of center leg 3–6 inches, width at the maximum, 4–6 inches and included angle between the divergent legs of 20–60 degrees and preferably 30 degrees. The preferred material is a moldable rigid plastic.

The terminus 26 of the center leg 20 is provided with a threaded connector, here shown as a stud 28 set in the leg 20 as shown, and projecting outward sufficiently for threaded connection to the stabilizer port 16 of the bow. It will be noted that the device 18 projects normal to the bow at its point of attachment; this arrangement can be varied if desired by gimbaling at its attachment, by adding articulation to the device or in some other manner.

The foregoing embodiment provides weight for stabilization but always in the same amount. The invention second embodiment provides an adjustable amount of weight.

Figure 3:
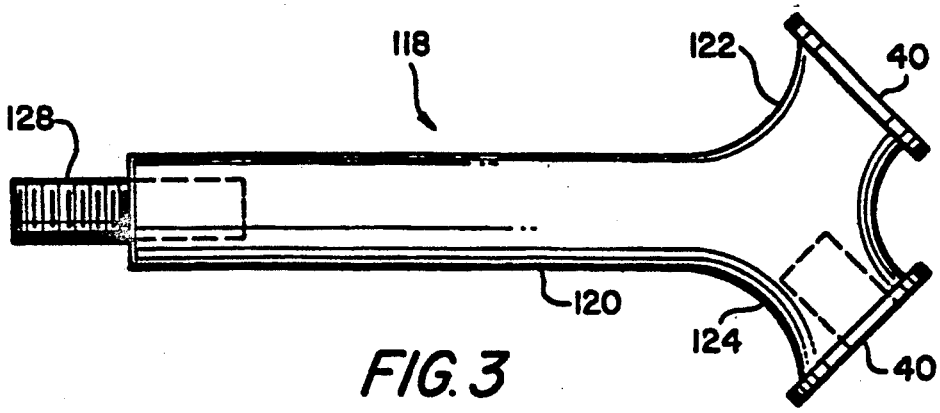
FIG. 3 is a plan view of the Y of a second embodiment thereof.

With reference now to FIGS. 3–6, the second form of the invention comprises an inverted Y device 118 with a center leg 120 and divergent legs 122, 124. These latter legs 122, 124 are fore shortened relative to the first embodiment and provided with terminal fastening means in the form of female threaded openings 40, as best shown in FIG. 3. The center leg 120 has a male threaded stud 128 as in the previous embodiment for connection to the bow 10 at the stabilizer port 16.

Figure 4:
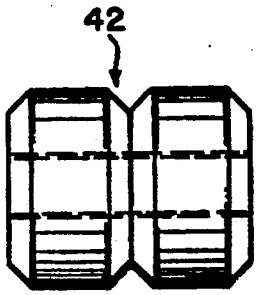
FIG. 4 is a plan view of a weight disc.
Figure 6:
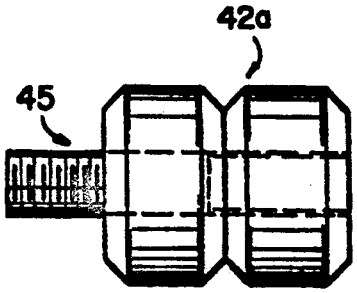
Figure 5:
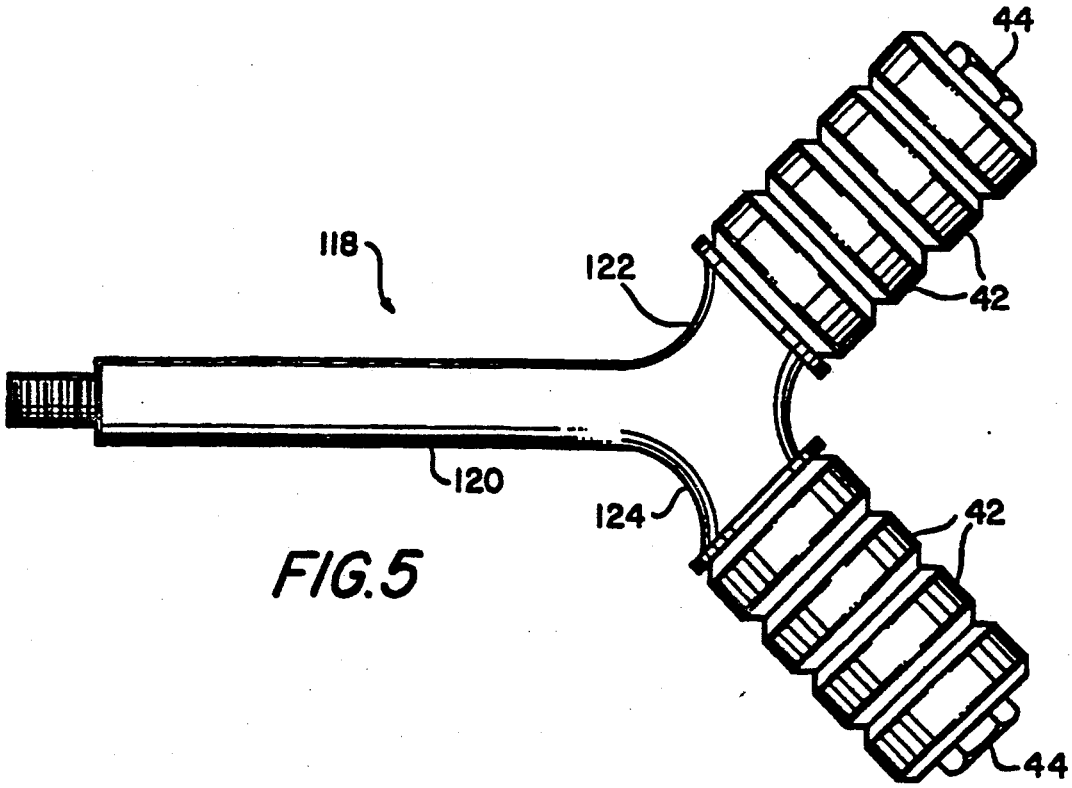
FIG. 5 is a plan view of an assembly of the Y and weight discs according to the invention; and, FIG. 6 is a view like FIG. 5 of an alternate form of weight disc.

In this embodiment, weight discs 42 of steel, aluminum or a combination of the two, or of other metals so as to have a variety of densities and thus different weight for the same size weight disc, shown in FIG. 4, are mounted to the truncated divergent legs 122, 124, by means of a bolt 44 passed through the center of the annular discs, or by a threaded stud 45 protruding from the end of the individual weight 42 as shown in FIG. 6, and threaded into the threaded openings 46 in legs 122, 124. The final assembly is as shown in FIG. 5. It will be noted that different combinations of weights can be used for different weight effects, and that the length of the legs 122, 224 is dependent on the number and size of the weights, both of which can be varied, mounted to the Y 118. Overall size and angular relationships will be approximately the same in both embodiments.

Thus the foregoing objects are met by the provision of a combination archery bow stabilizer and stand in which the weight is adjustable as described.

I claim:

1. A combination stabilizer and stand for an archery bow having a stabilizer port, comprising an inverted Y or rigid material of sufficient weight to act as a bow stabilizer, said Y having a center leg projecting normal to said bow a distance providing a leg outer end spaced substantially from said bow and two divergent legs which commence at the outer end of said center leg is substantially spaced relation to said bow, said center leg having terminal thread connection directly into the bow at the stabilizer port of the bow, said divergent legs being outwardly extended and spread sufficiently to support said bow with its end off the ground.

2. The combination bow stabilizer and stand according to claim 1, in which said rigid material is plastic, wood, or metal.

3. The combination bow stabilizer and stand according to claim 1, in which said center leg has male threads at the end thereof.

4. The combination bow stabilizer and stand according to claim 1, in which said center leg and said two divergent legs lie in a common plane.

5. The combination bow stabilizer and stand according to claim 1, in which said center leg and divergent legs are integrally formed, each defines a threaded terminal for attachment to the bow or to weights having complementary threading.

6. The combination bow stabilizer and stand according to claim 1, including weights mountable to said Y at said divergent legs.

7. The combination bow stabilizer and stand according to claim 6, in which said weights are mountable to said legs in predetermined increments of weight, said divergent legs define means to interconnect with said weights for mounting increments of weight to said Y for bow stabilization.

8. The combination bow stabilizer and stand according to claim 7, in which the extension of said divergent legs comprise in major proportion said weights.

9. The combination bow stabilizer and stand according to claim 8, in which said weights are metal discs, and including also means fastening said discs to each said divergent leg in increments of weight.

10. Combination bow stabilizer and stand comprising an inverted Y of rigid material, said Y having integrally formed center and divergent legs of like cross-section, said center leg projecting normal to said bow a distance providing outwardly a leg outer end spaced substantially from said bow and defining inwardly a threaded terminus adapted to thread connect said Y to a threaded stabilizer port on said bow, said Y having a pair of divergent legs commencing at the outer end of said center leg and defining terminal connection means, disc-shaped weight elements mountable to said divergent legs for adding length extension to said legs and stabilizing weight to said bow, and fastening means cooperating with said terminal connection means to support said weight elements on said legs, said legs being sufficiently extended and spread to support said bow with its end off the ground.

* * * * *

UNITED STATES PATENT AND TRADEMARK OFFICE

CERTIFICATE OF CORRECTION

PATENT NO. : 5,205,272

DATED : April 27, 1993

INVENTOR(S) : Bob Boyer

It is certified that error appears in the above-identified patent and that said Letters Patent is hereby corrected as shown below:

Column 3, line 36, delete "is" and insert --in--.

Signed and Sealed this

Fourteenth Day of December, 1993

*Attest:*

Bruce Lehman

BRUCE LEHMAN

*Attesting Officer*

*Commissioner of Patents and Trademarks*